US007822213B2

(12) United States Patent
Choi et al.

(10) Patent No.: US 7,822,213 B2
(45) Date of Patent: Oct. 26, 2010

(54) SYSTEM AND METHOD FOR ESTIMATING SPEAKER'S LOCATION IN NON-STATIONARY NOISE ENVIRONMENT

(75) Inventors: Chang-kyu Choi, Seoul (KR); Dong-geon Kong, Yongin-si (KR); Sun-gi Hong, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1524 days.

(21) Appl. No.: 11/165,288

(22) Filed: Jun. 24, 2005

(65) Prior Publication Data

US 2006/0002566 A1 Jan. 5, 2006

(30) Foreign Application Priority Data

Jun. 28, 2004 (KR) ..... 10-2004-0048927

(51) Int. Cl.
*H04R 3/00* (2006.01)

(52) U.S. Cl. ..... 381/92; 381/122; 381/56; 704/233

(58) Field of Classification Search ..... 381/92, 381/111, 122, 26, 56, 98; 367/99–116; 704/233
See application file for complete search history.

(56) References Cited

U.S. PATENT DOCUMENTS 4,995,011 A * 2/1991 Spiesberger ..... 367/127
5,737,431 A * 4/1998 Brandstein et al. ..... 381/92
6,160,758 A 12/2000 Spiesberger
6,449,593 B1 * 9/2002 Valve ..... 704/233
6,469,732 B1 * 10/2002 Chang et al. ..... 348/14.08
7,039,199 B2 * 5/2006 Rui ..... 381/92
7,586,513 B2 * 9/2009 Muren et al. ..... 348/14.01

FOREIGN PATENT DOCUMENTS

JP 2002-359767 12/2002

(Continued)

OTHER PUBLICATIONS

Sebastian Thrun, "Robotic Mapping: A Survey", School of Computer Science, Carnegie Mellon University, Pittsburgh, PA, CMU-CS-02-111 (Feb. 2002).

(Continued)

*Primary Examiner*—Vivian Chin
*Assistant Examiner*—Jason R Kurr
(74) *Attorney, Agent, or Firm*—Staas & Halsey LLP

(57) ABSTRACT

A system and method to estimate a location of a speaker who produces a sound signal even in a non-stationary noise environment. The system includes a signal input module receiving a first sound signal from an outside; an initialization module preparing a sound map, on which a spatial spectrum for the first sound signal, produced from at least one fixed sound source and received by the signal input module, is arranged, and estimating a location of the fixed sound source; a storage module storing information about the estimated location of the fixed sound source; and a speaker's location estimation module estimating a location where a second sound signal is produced using information about the spatial spectrum for sound signals including the first sound signal received by the signal input module and the information about the estimated location of the fixed sound source.

26 Claims, 19 Drawing Sheets

FOREIGN PATENT DOCUMENTS

KR 10-2005-0035562 4/2005

OTHER PUBLICATIONS

Nobuyuki Otsu, "A Threshold Selection Method from Gray-Level Histograms", IEEE (1979).

Michael Oren, et al., "Pedestrian Detection Using Wallet Templates," IEEE (1997), pp. 193-199.

Akira Utsumi, et al., "Human Detection using Geometrical Pixel Value Structures", Proceedings of the fifth IEEE International Conference on Automatic Face and Gesture Recognition (2002).

Paul Viola, et al., "Detecting Pedestrians Using Patterns of Motion and Appearance", Proceedings of the ninth IEEE International Conference on Computer Vision (ICCV 2003) 2-vol. Set.

Paul Viola, et al., "Rapid Object Detection using a Boosted Cascade of Simple Features," Accepted Conference on Computer Vision and Pattern Recognition, 2001.

Korean Office Action (w/ translation) issued on Dec. 16, 2005.

* cited by examiner

FIG. 16

```
int window[T][360];                                    /* 1ST LINE */
bool blob[360];                                        /* 2ND LINE */
int t, dir, detect_count;                              /* 3RD LINE */
int threshold=4;                                       /* 4TH LINE */
                                                       /* 5TH LINE */
for ( dir=0 ; dir < 360; dir++ )                       /* 6TH LINE */
{                                                      /* 7TH LINE */
        detect_count = 0;                              /* 8TH LINE */
                                                       /* 9TH LINE */
        for ( t=0 ; t < T ; t++ )                      /* 10TH LINE */
        {                                              /* 11TH LINE */
                if ( window[t][dir] < 128 )            /* 12TH LINE */
                {                                      /* 13TH LINE */
                        detect_count = detect_count+1; /* 14TH LINE */
                }                                      /* 15TH LINE */
        }                                              /* 16TH LINE */
        if ( detect_count > threshold )                /* 17TH LINE */
        {                                              /* 18TH LINE */
                blob[dir] = TRUE;                      /* 19TH LINE */
        }                                              /* 20TH LINE */
        else                                           /* 21TH LINE */
        {                                              /* 22ND LINE */
                blob[dir] = FALSE;                     /* 23RD LINE */
        }                                              /* 24TH LINE */
}                                                      /* 25TH LINE */
```

SYSTEM AND METHOD FOR ESTIMATING SPEAKER'S LOCATION IN NON-STATIONARY NOISE ENVIRONMENT

CROSS-REFERENCE TO RELATED APPLICATIONS

This application claims priority from Korean Patent Application No. 10-2004-0048927 on Jun. 28, 2004 in the Korean Intellectual Property Office, the disclosure of which is incorporated herein by reference.

BACKGROUND OF THE INVENTION

1. Field of the Invention

The present invention relates generally to the estimation of a speaker's location, and more particularly to a system and method for estimating a speaker's location even in a non-stationary noise environment by preparing a sound map and using the prepared sound map information.

2. Description of the Related Art

With the development of technologies in diverse fields such as electronics, communications, machinery, etc., human life becomes more convenient. In diverse fields, automatic systems that move and work for humans have been developed, and such automatic systems are commonly called robots.

Some robots can recognize a human voice and take proper action according to the recognized human voice. In some cases, it is required for the robot to recognize the human voice and estimate a location from which the voice is produced.

To accomplish this, Japanese Patent Laid-open No. 2002-359767 discloses a camera device that tracks a location of a sound source in a stationary noise environment. This camera device has a drawback in that it has difficulty in tracking the sound source in a non-stationary environment.

U.S. Pat. No. 6,160,758 discloses a method of estimating the location of a sound source. But it is difficult to adapt this method to an indoor environment and to estimate the location of a speaker who produces a sound.

Accordingly, there is a demand to provide a method for estimating the location of a speaker who produces a sound by recognizing the sound even in a non-stationary noise environment.

SUMMARY OF THE INVENTION

Accordingly, an aspect of the present invention is to provide a system and method for estimating a speaker's location even in a non-stationary noise environment.

Additional aspects and/or advantages of the invention will be set forth in part in the description which follows and, in part, will be apparent from the description, or may be learned by practice of the invention.

According to one aspect, there is provided a system to estimate a speaker's location in a non-stationary noise environment, including a signal input module receiving a first sound signal from an outside; an initialization module preparing a sound map, on which a spatial spectrum for the first sound signal produced from at least one fixed sound source and received by the signal input module is arranged, and estimating a location of the fixed sound source; a storage module storing information about the estimated location of the fixed sound source; and a speaker's location estimation module estimating a location where a second sound signal is produced using information about a spatial spectrum for sound signals including the first sound signal received by the signal input module and the information about the estimated location of the fixed sound source.

In another aspect of the present invention, there is provided a method for estimating a speaker's location in a non-stationary noise environment, comprising the operations of (a) preparing a sound map on which a spatial spectrum for a first sound signal produced from at least one fixed sound source is arranged; (b) estimating a location of the fixed sound source from the sound map; (c) storing information about the estimated location of the fixed sound source; and (d) estimating a location where a second sound signal is produced using information about a spatial spectrum for sound signals including the first sound signal and the information about the estimated location of the fixed sound source, if the second sound signal is detected.

BRIEF DESCRIPTION OF THE DRAWINGS

The patent or application file contains at least one drawing executed in color. Copies of this patent or patent application publication with color drawings will be provided by the Office upon request and payment of the necessary fee. These and/or other aspects and advantages of the invention will become apparent and more readily appreciated from the following description of the embodiments, taken in conjunction with the accompanying drawings of which:

FIG. 16 is a view exemplifying a source program to perform a method for detecting blobs according to an embodiment of the present invention;

DETAILED DESCRIPTION

Figure 1:
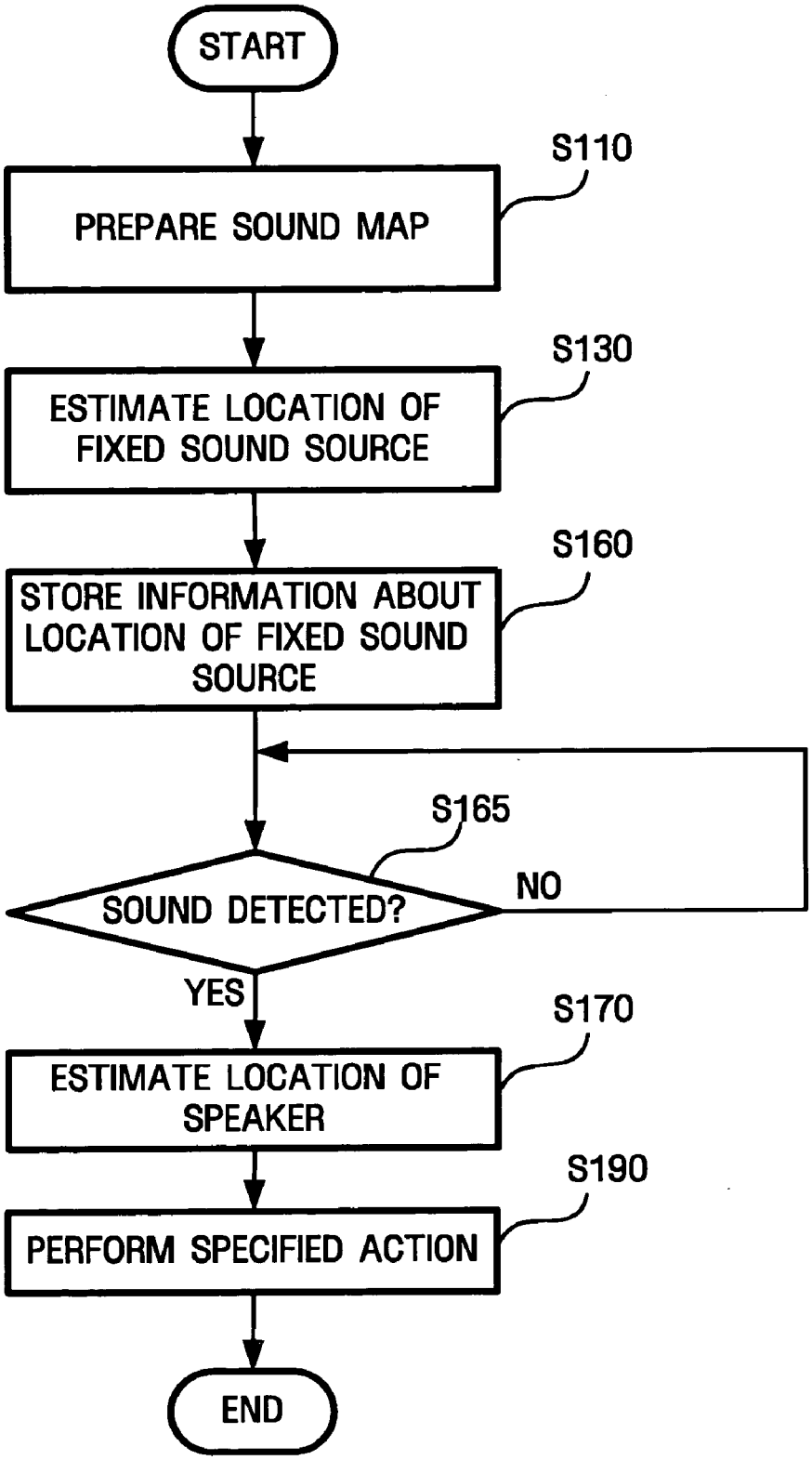
FIG. 1 is a flowchart schematically illustrating a method for estimating a speaker's location according to an embodiment of the present invention.

Reference will now be made in detail to embodiments of the present invention, examples of which are illustrated in the accompanying drawings, wherein like reference numerals refer to the like elements throughout. The embodiments are described to explain the present invention by referring to the figures.

The present invention is described hereinafter with reference to flowchart illustrations of methods according to embodiments of the invention. It will be understood that each block of the flowchart illustrations, and combinations of blocks in the flowchart illustrations, can be implemented by computer program instructions. These computer program instructions can be provided to a processor of a general purpose computer, special purpose computer, or other programmable data processing apparatuses to produce a machine, such that the instructions, which execute via the processor of the computer or other programmable data processing apparatuses, implement the functions specified in the flowchart block or blocks.

These computer program instructions may also be stored in a computer usable or computer-readable memory that can direct a computer or other programmable data processing apparatuses to function in a particular manner, such that the instructions stored in the computer usable or computer-readable memory produce an article of manufacture including instructions that implement the function specified in the flowchart block or blocks.

The computer program instructions may also be downloaded into a computer or other programmable data processing apparatuses, causing a series of operations to be performed on the computer or other programmable apparatuses to produce a computer implemented process such that the instructions that execute on the computer or other programmable apparatuses provide operations to implement the functions specified in the flowchart block or blocks.

And each block of the flowchart illustrations may represent a module, segment, or portion of code, which includes one or more executable instructions to implement the specified logical function(s). It should also be noted that in some alternative implementations, the functions noted in the blocks may occur in a different order. For example, two blocks shown in succession may in fact be executed almost concurrently, or the blocks may sometimes be executed in the reverse order, depending upon the functionality involved.

To facilitate the explanation of the invention, several terms are defined as follows:

(1) Global map: Map in which a specified planar space is divided into lattice areas, and the respective divided area has location information (2) Speaker: Person who produces a sound in a specified planar space indicated by a global map (3) Robot: System that estimates the location of a speaker (4) Cell: Divided lattice area in a global map (5) Sound map: Map in which a spatial spectrum indicating a direction of a sound source is arranged for each cell of a global map (6) Local coordinates: Two-dimensional plane coordinates based on a direction to which a robot tends (7) Global coordinates: Two-dimensional plane coordinates for a specified planar space indicated by a global map (8) Fixed sound source: Device that produces a noise at a fixed location, i.e., device that exists in a planar space indicated by a global map, and produces a non-stationary noise (9) Non-stationary noise: every sound signal except for a sound signal produced by a speaker, i.e., every sound signal that is produced by every fixed sound source or that is abruptly produced from an environment outside a robot (for example, noise produced when a door is open or closed)

(10) Sound signals: signals that include a sound signal produced by a speaker and all other noise signals FIG. 1 is a flowchart schematically illustrating a method of estimating a speaker's location according to an embodiment of the present invention.

For a robot to estimate the location of a speaker according to an embodiment of the present invention, the robot should first obtain location information about fixed sound sources existing in a planar space in which the robot is presently moving.

Accordingly, the robot prepares a sound map at an initialization operation to estimate the speaker's location (operation S110), and estimates the location of fixed sound sources using the prepared sound map (operation S130). Then, it stores the location information of the estimated fixed sound sources in a storage area such as a memory provided in the robot (operation S160). later, with reference to FIGS. 2 and 7, a method of preparing the sound map and a method of estimating the location of the fixed sound sources will be explained in detail.

If the robot detects a sound while it is in a standby state, the robot estimates the speaker's location using the pre-stored position information of the fixed sound sources and the detected sound signal (operation S170). In the event that the sound signal produced by the speaker includes information that requires a specified operation, the robot performs a specified action according to the information (operation S190).

Figure 2:
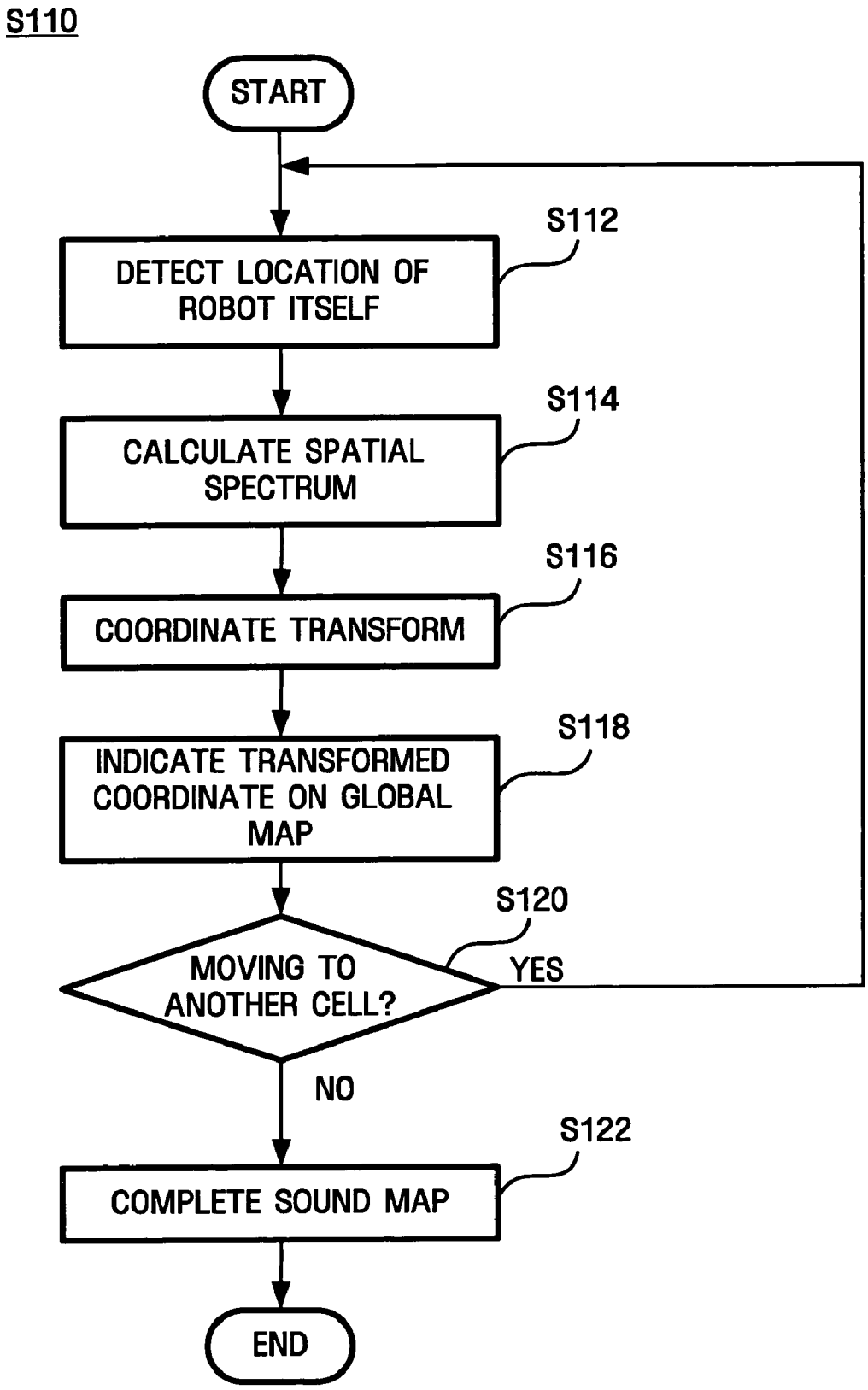
FIG. 2 is a flowchart illustrating a method for preparing a sound map according to an embodiment of the present invention.

FIG. 2 is a flowchart illustrating a method for preparing a sound map according to an embodiment of the present invention. According to one embodiment, the sound map is periodically updated.

The robot detects its own location on the global map, i.e., a directional angle to which the robot tends, and a two-dimensional plane coordinates value (for example x-y position) in the global coordinates (operation S112).

The robot can obtain information about the global map and its own location information on the global map from a navigation system provided in the robot. According to one embodiment, the navigation system includes software, hardware, and combination of the software and hardware to process information about the movement and location of the robot. The navigation system may include a module for processing information about the global map for the planar space to which the robot itself belongs, and a module for detecting the location of the robot itself on the global map.

The term 'module', as used herein, means, but is not limited to, a software or hardware component, such as an FPGA (Field Programmable Gate Array) or an ASIC (Application Specific Integrated Circuit), which performs certain tasks. A module may advantageously be configured to reside on the addressable storage medium and configured to execute on one or more processors. Thus, a module may include, by way of example, components, such as software components, object-oriented software components, class components and task components, processes, functions, attributes, procedures, subroutines, segments of program code, drivers, firmware, microcodes, circuitry, data, databases, data structures, tables, arrays, and variables. The functionality provided for in the components and modules may be combined into fewer components and modules or further separated into additional components and modules.

A method of detecting the location of the robot itself using the navigation system is disclosed in 'Robotic Mapping: A Survey', which is a thesis written by Sebastian Thrun.

For the robot to prepare the sound map, fixed sound sources are required. Accordingly, after or before detecting its own location, the robot constructs an environment in which the non-stationary noise is continuously produced from the fixed sound sources.

The robot calculates the spatial spectrum for every cell as it moves in order through the respective cells in the global map (operation S114). The spatial spectrum is obtained by representing in the form of a spectrum the intensities of sound signals received in all directions around a robot. Accordingly, using the spatial spectrum, the direction of a sound source can be found in the present location of the robot. In this case, the robot may calculate the spatial spectrum using a MUSIC (Multiple Signal Classification) algorithm, but an ESPRIT algorithm, an algorithm based on time-delay estimation, an algorithm based on beam forming, etc., may be used instead. Such algorithms are well known in the art.

If the spatial spectrum in a specified cell is obtained, the robot performs a coordinate transform between local coordinates and global coordinates (operation S116). Since the spatial spectrum is for estimating the direction of the fixed sound sources based on the local coordinates, it is necessary to perform the coordinate transform from the local coordinates to the global coordinates to estimate the direction of the fixed sound sources using the sound map.

Figure 3:
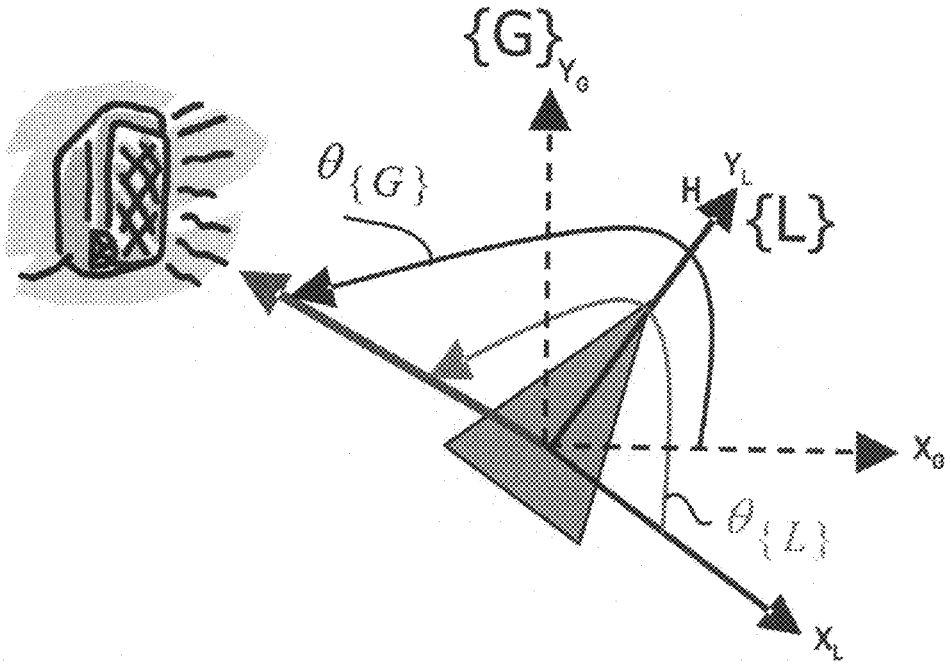
FIG. 3 is a view exemplifying a relation between local coordinates of a robot and global coordinates of a plane that the robot belongs to according to an embodiment of the present invention.

FIG. 3 is a view exemplifying a relation between the local coordinates of the robot and the global coordinates of the plane which the robot belongs to according to an embodiment of the present invention.

In FIG. 3, the global coordinate system is denoted as '{G}', and indicated as a dotted line. The local coordinate system is denoted as '{L}', and indicated as a solid line. In the local coordinate system, the direction to which the robot tends is denoted as 'H'.

Accordingly, the direction of the fixed sound source indicated as a speaker $\theta_{\{G\}}$ on the basis of an axis $X_G$ from the viewpoint of the global coordinates, and $\theta_{\{L\}}$ on the basis of axis $X_L$ from the viewpoint of the local coordinates.

The coordinate transform from the local coordinates to the global coordinates can be calculated by a following equation 1.

$$P_G = \begin{bmatrix} x_G \\ y_G \end{bmatrix} = \begin{bmatrix} \cos\theta & -\sin\theta \\ \sin\theta & \cos\theta \end{bmatrix} \begin{bmatrix} x_L \\ y_L \end{bmatrix} + P \qquad \text{[Equation 1]}$$

Here, $P_G$ denotes the location of a robot on the global coordination, and θ denotes an angle between the global coordinate axis and the local coordinate axis. Also, P denotes the location of the original point of the local coordinate system on the basis of the original point of the global coordinate system.

Using the coordinate transform for the fixed sound source, the direction of the fixed sound source is indicated on the global map (operation S118).

Then, the robot moves to another cell in which the spatial spectrum is not calculated, and repeats the operations S112, S114, S116 and S118. If the spatial spectrum has been calculated for all the preset cells existing on the global map, the sound map is completed (operation S122), and the robot estimates the location of the fixed source using information about the completed sound map (operation S130).

Figure 4:
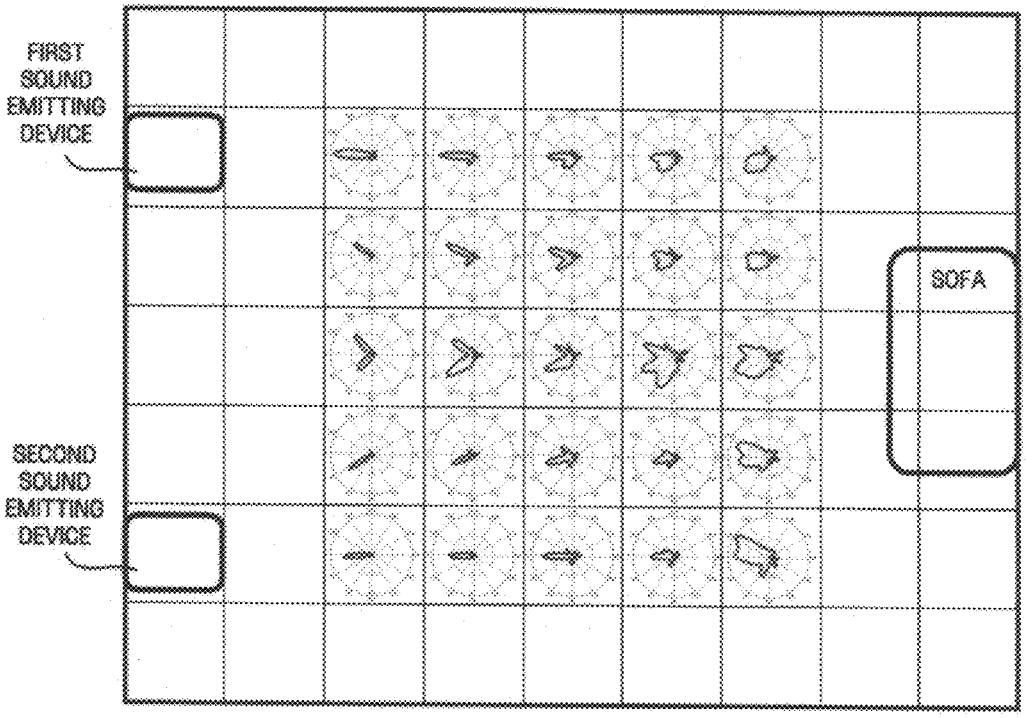
FIG. 4 is a view exemplifying a sound map having two sound emitting devices (SEDs) as fixed sound sources according to an embodiment of the present invention.
Figure 5:
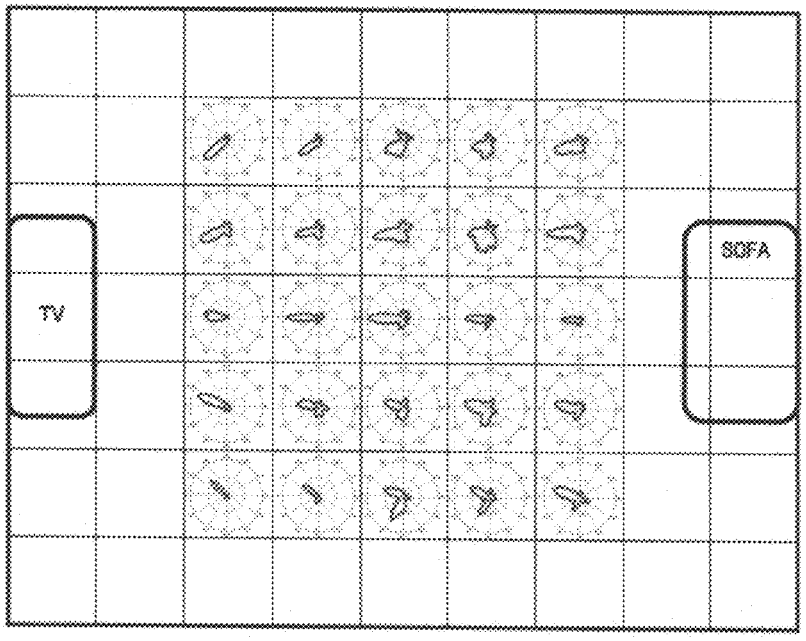
FIG. 5 is a view exemplifying a sound map having a television receiver (TV) as a fixed sound source according to an embodiment of the present invention.
Figure 6:
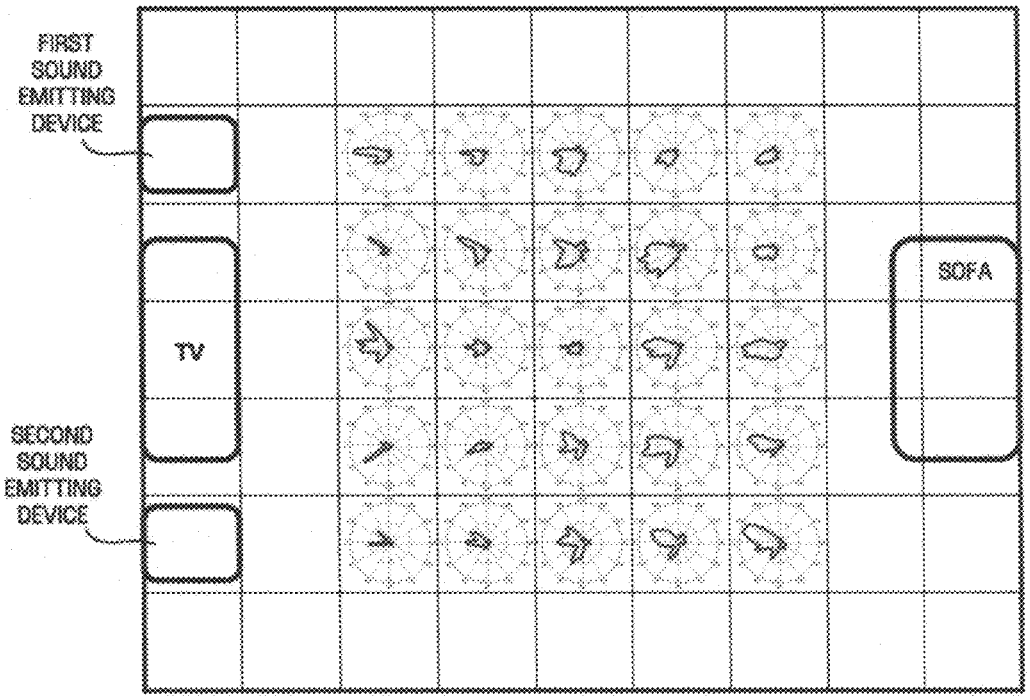
FIG. 6 is a view exemplifying a sound map having a television receiver (TV) and two SEDs as fixed sound sources according to an embodiment of the present invention.

FIGS. 4 to 6 are views exemplifying sound maps in which the spatial spectra for fixed sound sources are indicated according to embodiments of the present invention.

FIG. 4 shows a sound map having two sound emitting devices (SEDs), such as a pair of loudspeakers, as fixed sound sources, FIG. 5 shows a sound map having a television receiver (TV) as a fixed sound source, and FIG. 6 shows a sound map having a television receiver (TV) and two SEDs as fixed sound sources.

The spatial spectra illustrated in FIGS. 4 to 6 are indicated on the basis of the local coordinate system. In calculating the spatial spectrum, the number of optimized fixed sound sources (hereinafter referred to as 'Ns') that can be detected as a parameter is set to '3' under the assumption that the number of sound sources existing in a specified time is generally three.

In another embodiment of the present invention, in the case of calculating the spatial spectrum as the robot moves freely rather than calculating the spatial spectrum for a specified cell to estimate the location of the fixed sound sources, the spatial spectrum may be calculated repeatedly in a specified location. In this case, an average of the repeatedly calculated spatial spectrum may be obtained.

Figure 7:
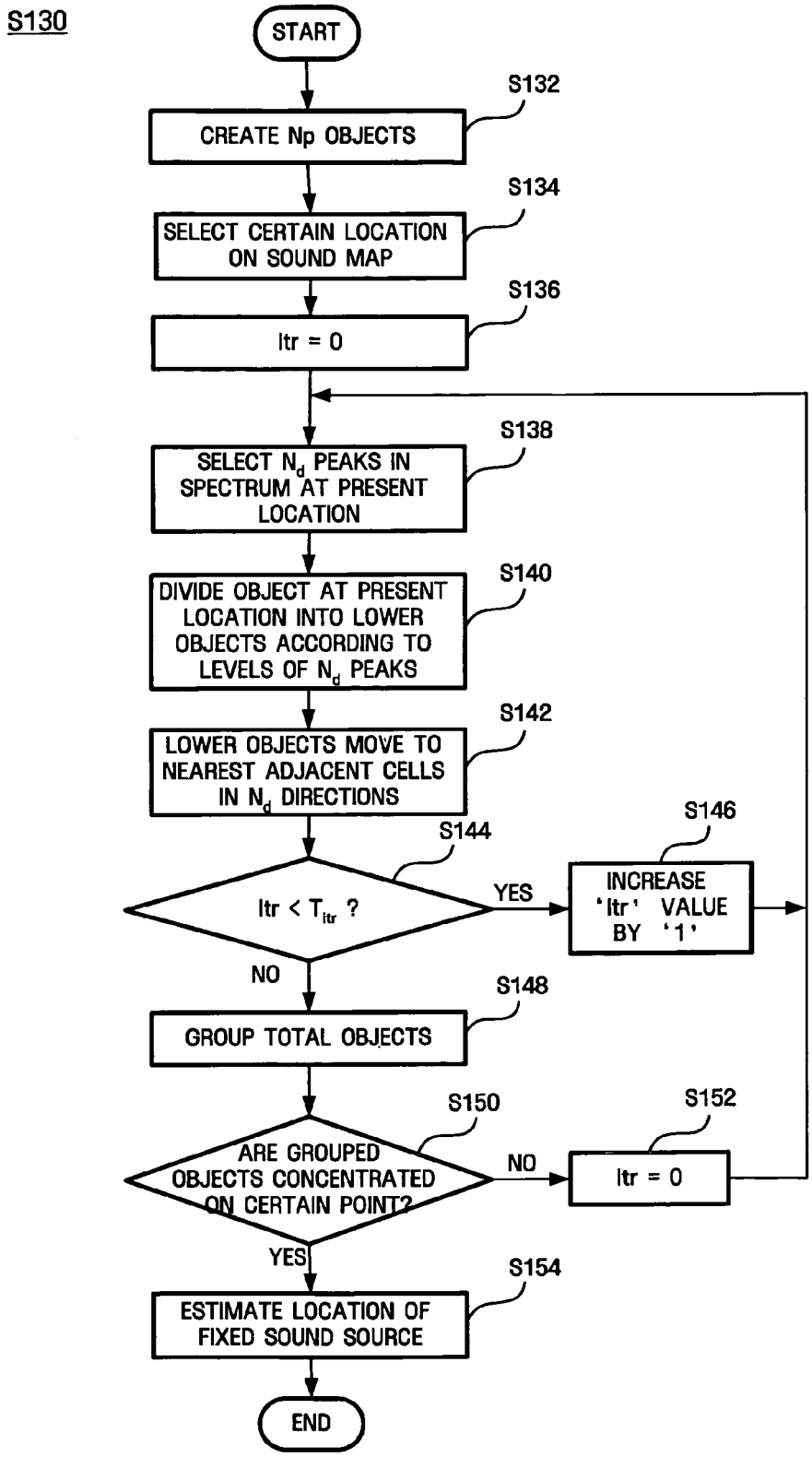
FIG. 7 is a flowchart illustrating a method for estimating the location of fixed sound sources according to an embodiment of the present invention.

FIG. 7 is a flowchart illustrating a method for estimating the location of fixed sound sources using information about a prepared sound map according to an embodiment of the present invention.

Referring to FIG. 7, the robot creates $N_p$ objects by software (operation S132), and locates the created objects in certain cells illustrated in the sound map (operation S134). For instance, if five objects are created, the objects are located in five selected cells, respectively. In this case, the object may be considered as a variable that indicates the location of the cell by software.

An 'Itr' variable is an index variable that indicates a period for which all the objects existing on the sound map move once. The initial value of the 'Itr' variable is set to '0' (operation S136).

Operations S138 to S142 refer to a method of moving one object in the direction of the fixed sound source. These operations are also applied to other ($N_p$−1) objects in the same manner.

Specifically, the robot selects $N_d$ peaks in the spatial spectrum of each cell in which each object is presently located (operation S138). If the number of fixed sound sources is '1', it produces only one peak, while if the number of fixed sound sources is plural, it produces peaks of which the number is as many as that of the fixed sound sources.

Then, the robot divides the present object into lower objects according to a size of the peak(s) (operation S140). For example, if one object is located in a certain cell and the spatial spectrum in the cell has one peak, the robot does not create the lower objects. But if the spatial spectrum has two peaks of a similar size, it divides the object into two lower objects. That is, two objects are created from one object. Also, if the two peaks have different sizes, the robot may create the lower objects in proportion to the rate of their sizes. A designer who designs the robot may preset such a rule.

The lower objects created as described above move to the nearest adjacent cells located in directions of $N_d$ peaks (operation S142).

If all the objects move once by the method such as operations S138 to S142, the robot compares the value of the 'Itr' variable with the value of '$T_{itr}$' variable that indicates the maximum value of the period in which all the objects existing on the sound map move once (operation S144). In this case, the value of the '$T_{itr}$' variable is preset.

If the value of the 'Itr' variable is smaller than the value of the '$T_{itr}$' variable, the robot increases the value of the 'Itr' variable by one (operation S146), and repeatedly performs operations S138 to S142 since the respective objects can move further.

But if the value of the 'Itr' variable is not smaller than the value of the '$T_{itr}$' variable, the robot stops the movement of the objects, and groups the objects located in the respective cells of the present sound map according to a specified rule (operation S148). In this case, the robot may group the objects included in the respective cells into one group, or may group the objects among which the distances are within a predetermined range into one group.

In this case, the robot observes if the grouped objects are concentrated on a specified point of the sound map (operation S150), and if so, it considers that the fixed sound source exists at the concentrated point, and estimates the location of the fixed sound source (operation S154).

If the grouped objects are not concentrated on the specified point of the sound map, the robot initializes the value of the 'Itr' variable as '0' (operation S152), and performs operation S138.

Figure 8:
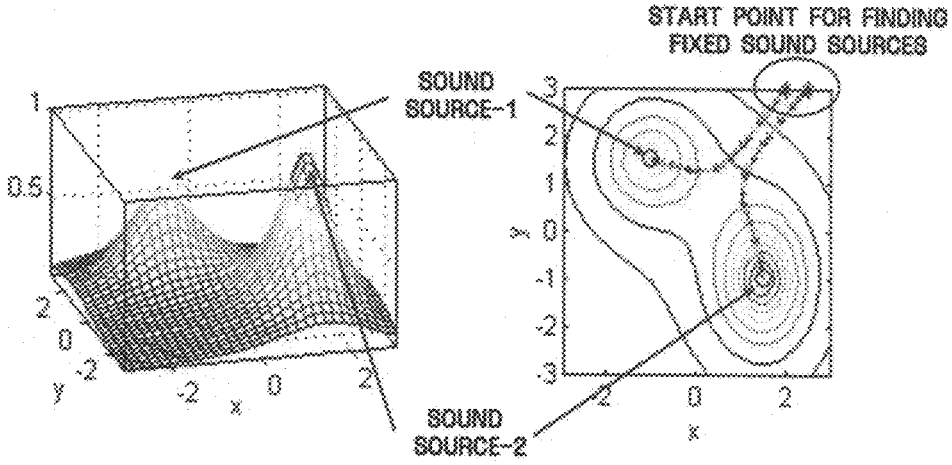
FIG. 8 is a graph showing a method for estimating the location of fixed sound sources according to another embodiment of the present invention.

FIG. 8 is a graph showing a method for estimating the location of fixed sound sources according to another embodiment of the present invention.

It is assumed that as the level of the sound produced by the fixed sound source becomes higher, or exceeds a predetermined threshold, a virtual potential function having a larger potential exists on the global map.

In this case, if direction vectors that indicate peaks of the spatial spectrum arranged on the sound map represent gradient information of the potential function, all the maximum values of the potential function can be found through a gradient ascent method. The locations of the maximum values found as above become the locations of the fixed sound sources.

Figure 9:
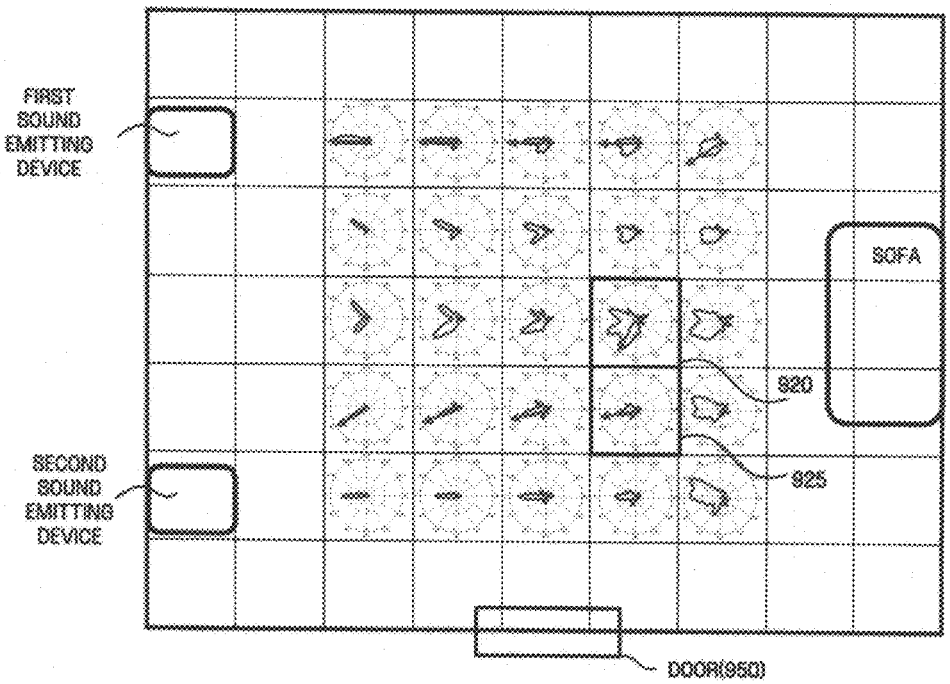
FIG. 9 is a view exemplifying the estimation of fixed sound sources using a sound map, even in an environment where an instantaneous noise is produced, according to an embodiment of the present invention.

FIG. 9 is a view exemplifying the estimation of fixed sound sources even in an environment where an instantaneous noise is produced using a sound map according to an embodiment of the present invention.

For example, in a state that the robot is located in the cell denoted as '920', a sound produced due to an opening and/or closing of a door 950 corresponds to a non-stationary noise. In this case, a strong spatial spectrum is produced in a direction where the door 950 is located, and it appears as if a fixed sound source exists in the direction where the door 950 is located. But if an object moves by the method as shown in FIG. 7 to a cell 925 in order to determine the location of the fixed sound source, no more spatial spectrum in the direction where the door 950 is located exists in the cell 925. As a result, any instantaneous noise does not affect the estimation of the location of the fixed sound source.

According to one embodiment, the Ns value that indicates the number of detectable optimized fixed sound sources is set to '3' during the calculation of the spatial spectrum. But even if the number of fixed sound sources increases, the locations of the respective fixed sound sources can be estimated using the sound map.

Figure 10:
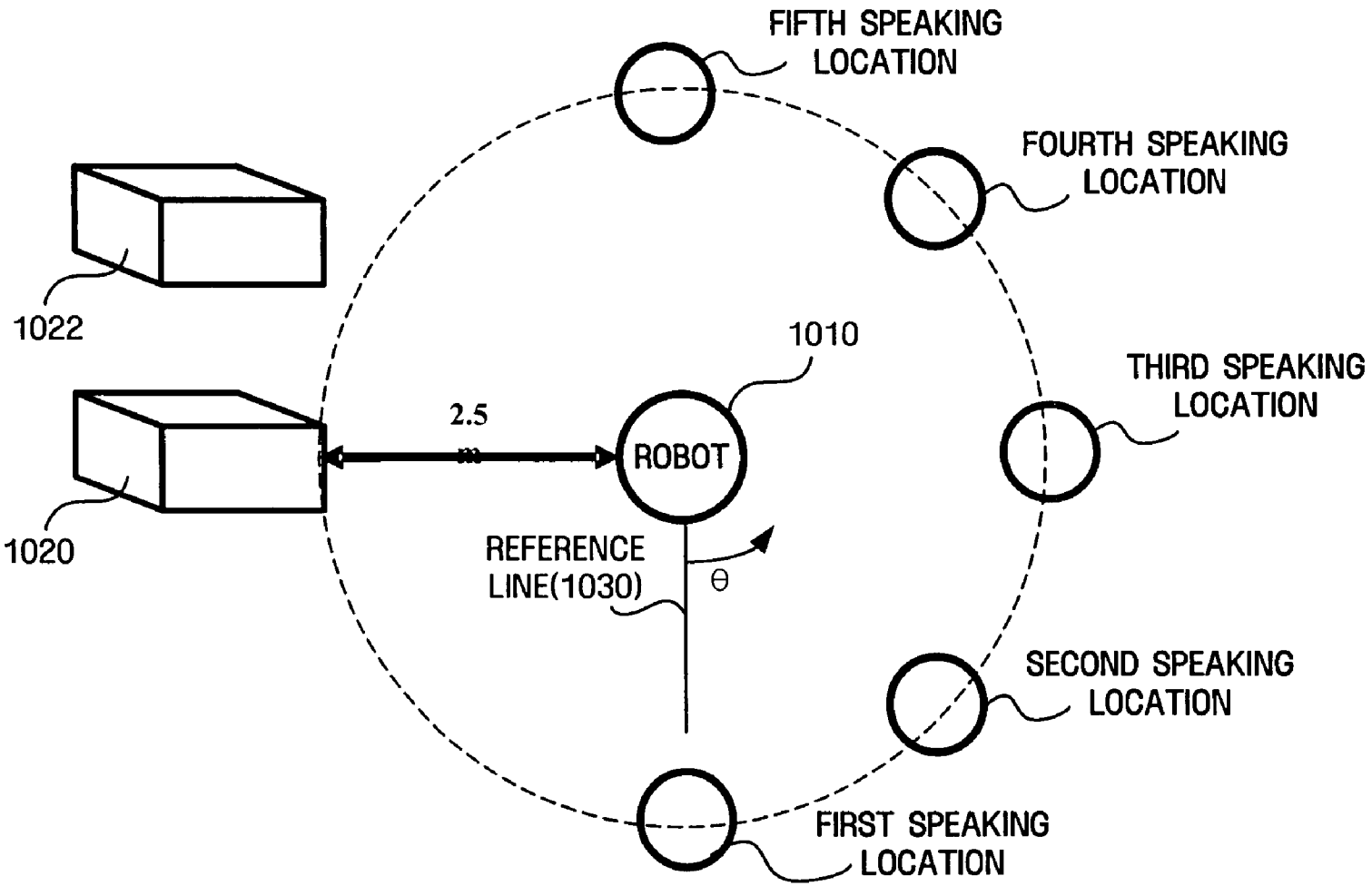
FIG. 10 is a view exemplifying an experimental environment for estimating a location of a speaker according to an embodiment of the present invention.

FIG. 10 is a view exemplifying an experimental environment for estimating the location of a sound emitting device according to an embodiment of the present invention. Here, first and second sound emitting devices 1020 and 1022 are the fixed sound sources producing the non-stationary noises.

The robot that estimates the locations of the sound emitting devices is 2.5 m apart from the first sound emitting device 1020. Also, the sound emitting device produces a sound as the sound emitting device moves in order through a first speaking location to a fifth speaking location as shown in FIG. 10. At this time, the angle θ increases counterclockwise on the basis of a reference line 1030 that connects the robot 1010 and the first speaking location, and the respective speaking locations are located at intervals of 45°.

Figure 11:
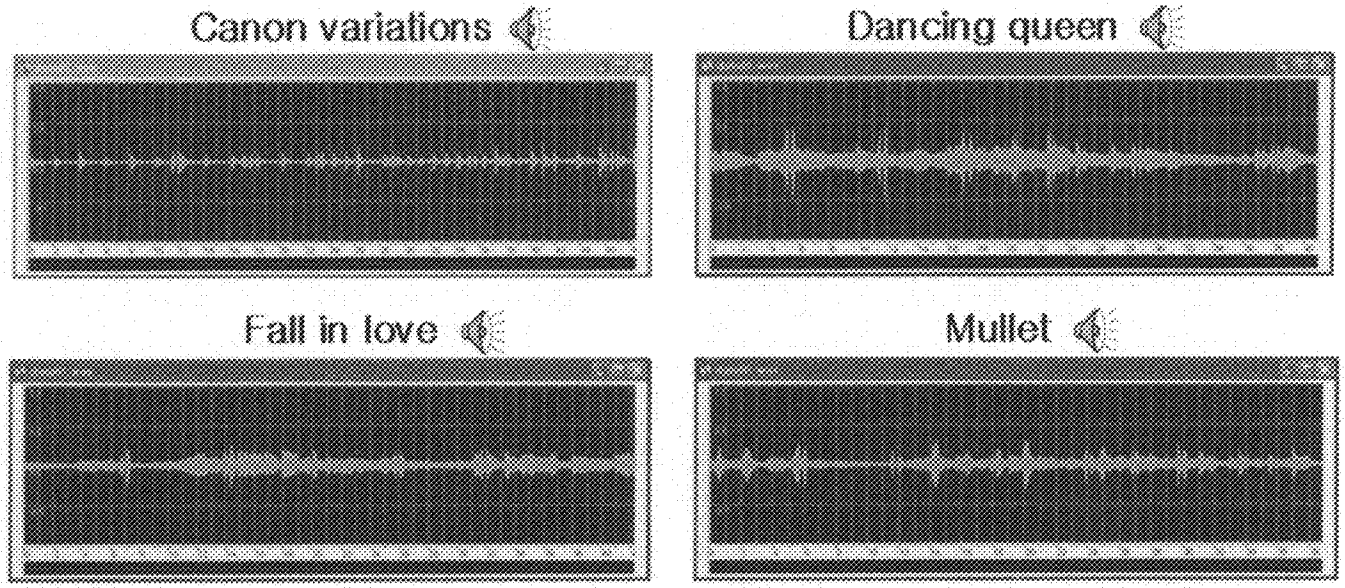
FIG. 11 is a view exemplifying waveforms of non-stationary noises according to an embodiment of the present invention.

FIG. 11 is a view exemplifying waveforms of non-stationary noises according to an embodiment of the present invention.

The waveforms illustrated in FIG. 11 correspond to different kinds of sounds produced from the sound emitting devices 1020 and 1022 as illustrated in FIG. 10, and hereinafter, for convenience's sake in explanation, the sound of the musical piece 'Canon Variations' is called a first noise, 'Dancing Queen' a second noise, 'Fall in Love' a third noise, and 'Mullet' a fourth noise, respectively.

Figure 12:
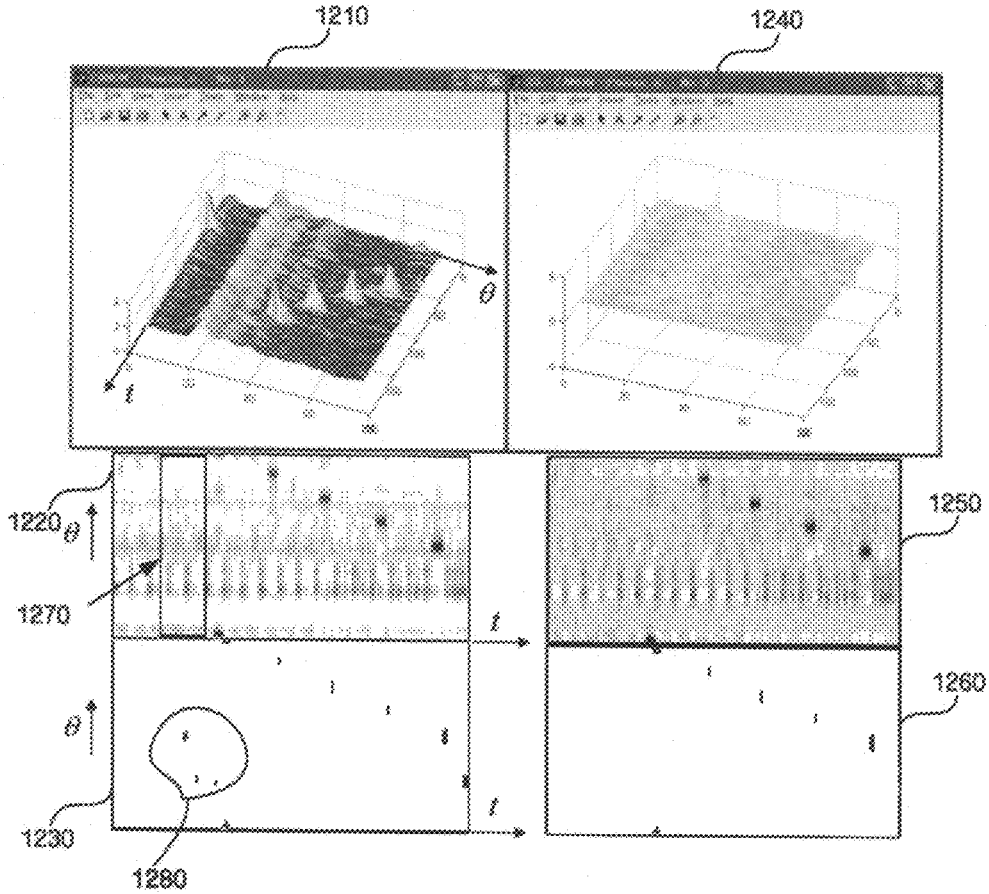
FIG. 12 is a view illustrating first resultant data that indicates the estimation of a speaker's location for a non-stationary noise according to an embodiment of the present invention.

FIG. 12 is a view illustrating first resultant data of experimentation that indicates the estimation of a sound emitting device's location for a non-stationary noise according to an embodiment of the present invention. In FIG. 12, the experimental results of estimating the locations of the sound emitting devices when the first noise is produced are illustrated.

A window 1210 illustrated on the left side of FIG. 12 shows the spatial spectra in the environment where the first noise is produced. Specifically, the window 1210 shows the spatial spectra in a spatio-temporal domain using a MUSIC algorithm, which is produced when the sound emitting device produces sounds at respective speaking locations illustrated in FIG. 10 after the robot prepares the sound map according to the embodiment of the present invention.

A window 1240 illustrated on the right side of the window 1210 shows the spatial spectra in the environment where the first noise is produced. Specifically, the window 1240 shows the spatial spectra in a spatio-temporal domain using a MUSIC algorithm with spectral subtraction, which is produced when the sound emitting device produces sounds at respective speaking locations illustrated in FIG. 10 after the robot prepares the sound map according to the embodiment of the present invention. In this case, the MUSIC algorithm with spectral subtraction detects the sound signals using spectrum information obtained by subtracting the pre-stored noise spectrum information from the spatial information including the sound signal when the sound signal is detected in the environment where the noise exists. Here, the pre-stored noise spectrum information can be obtained using the sound map according to the embodiment of the present invention.

Processed images 1220 and 1250 shown below the windows 1210 and 1240 are obtained by gray-scaling the spatial spectra shown in the windows 1210 and 1240. Hereinafter, images obtained by gray-scaling the spatial spectra are called 'first images'. A horizontal axis of the first image is a time axis, and a vertical axis represents a directional angle on the basis of the robot 1010.

The images below the first images 1220 and 1250 are images for estimating the direction where the sound exists by binarizing the first images 1220 and 1250. Hereinafter, the images are called 'second images'.

Figure 13:
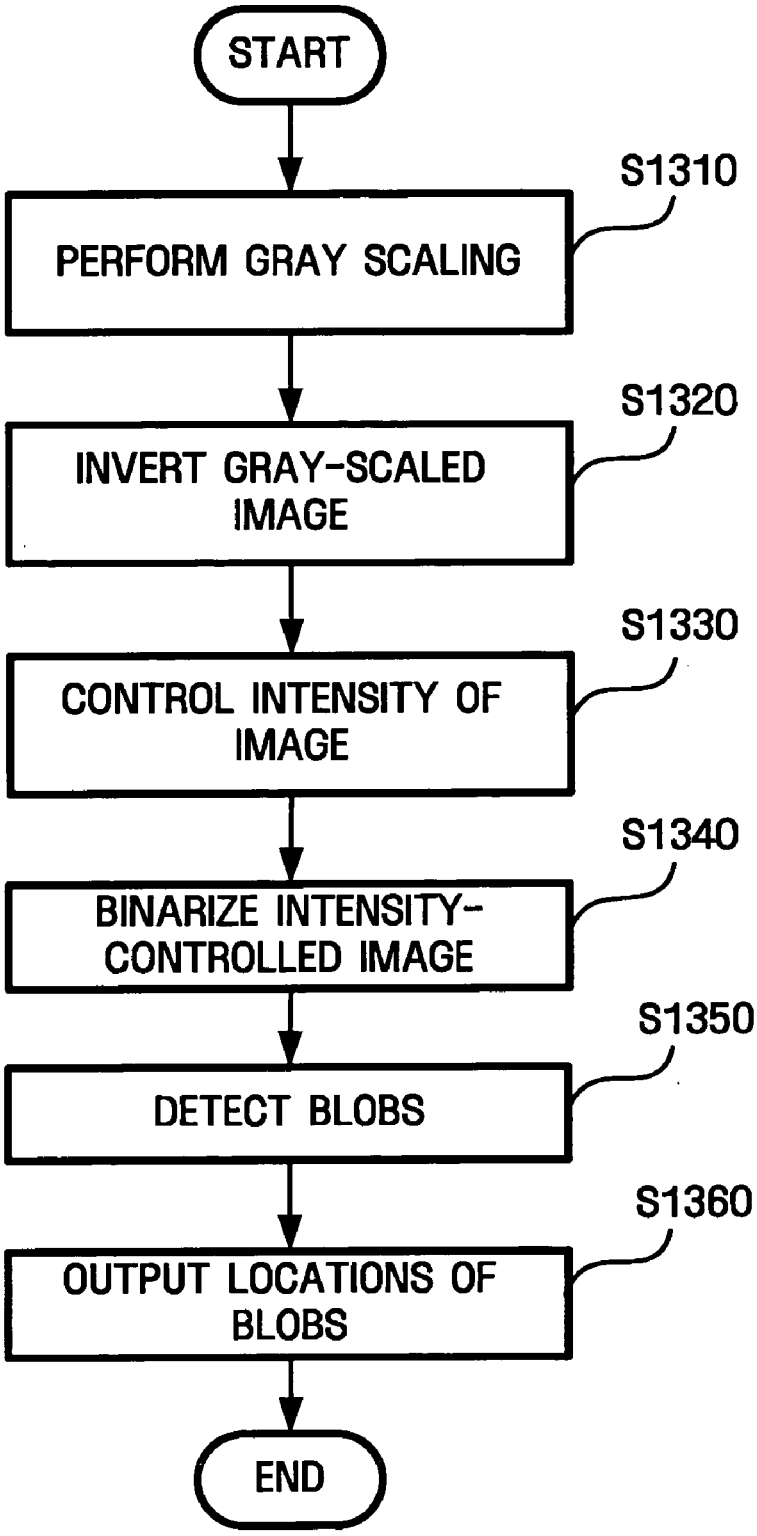
FIG. 13 is a flowchart illustrating a process for obtaining a second image from a first image according to an embodiment of the present invention.

In comparing the second images 1230 and 1260, blobs 1280, which indicate that sounds exist at a time when or in a direction where no sound exists, appear in the second image 1230 located on the left side. By contrast, no blob appears in the second image located on the right side. Accordingly, if the spatial spectrum is obtained using the MUSIC algorithm with spectral subtraction and the processed image is obtained from the spatial spectrum, the direction where the sound exists can be detected more accurately. A process of obtaining the second image 1260 using the first image 1250 is illustrated in FIG. 13.

Figure 14:
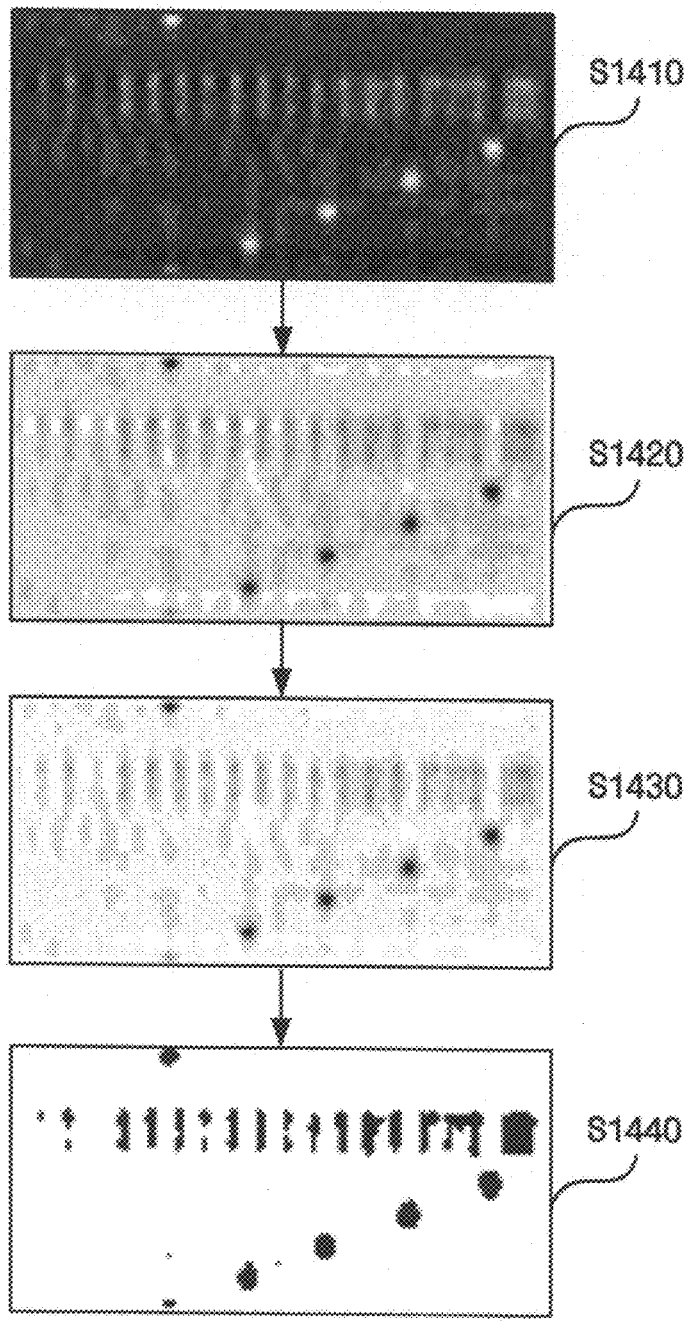
FIG. 14 is a view exemplifying images corresponding to respective operations as illustrated in FIG. 13.

The spatial spectra of the window 1240 as illustrated in FIG. 12 are converted into an image on a two-dimensional planar space by converting the spatial spectra into gray scales corresponding to levels of the sound signal (operation S1310). In this case, the two-dimensional planar space is composed of a time axis that is a horizontal axis and a direction axis around the robot that is a vertical axis. Accordingly, if information that indicates the intensity is composed of one byte, the spatial spectrum can be converted into 256 gray scales in all. Accordingly, in the case of the largest sound level, its value becomes 255, and the converted image appears white. The image obtained at operation S1410 in FIG. 14 shows the result of gray scaling.

The gray-scaled image is then inverted (operation S1320), and the image obtained at operation S1420 shows the result of inversion.

According to the method of inverting the image, if it is defined that the intensity at point (x, y) located on the two-dimensional planar space is I(x, y), the inverted image I'(x, y) can be obtained by a following equation 2.

$$I'(x,y)=255-I(x,y) \quad \text{[Equation 2]}$$

To emphasize the black/white state of the inverted image, an operation to control the intensity is performed (step S1330). For this, average values avg of intensities of pixels located in an edge portion of the inverted image are obtained, and then the maximum and minimum values max and min of the image pixels are obtained. If the average value avg of the intensity is larger than the minimum value min of the image pixel, the inverted image is processed by a following equation 3, while otherwise, the inverted image is processed by a following equation 4. In this manner, the black/white state of the inverted image can be emphasized. The image obtained at operation S1430 of FIG. 14 shows the result of emphasis.

$$I'(x, y) = \frac{I'(x, y) - \min}{avg - \min} \quad \text{[Equation 3]}$$

-continued $$I'(x, y) = \frac{I'(x, y) - \min}{\max - \min} \quad \text{[Equation 4]}$$

Until the operation S1330 as illustrated in FIG. 13, the level of the sound signal appears as the gray scale. Then, the image is binarized at operation S1340. Specifically, all the pixels appearing in the image are indicated as black or white on the basis of a predetermined threshold value.

For example, if I'(x, y) is larger than the threshold value, it is set that I'(x, y)=255, while otherwise, it is set that I'(x, y)=0. In this case, the threshold value may be set to a value that is smaller by 10 than the value obtained by an Otsu method.

The Otsu method is described in detail in 'A threshold selection method form gray-level histograms (IEEE Transactions on Systems, Man, and Cybernetics 9(1):62-66)' proposed by Otsu. The image obtained at operation 1440 of FIG. 14 shows the result of binarizing the image.

Figure 15:
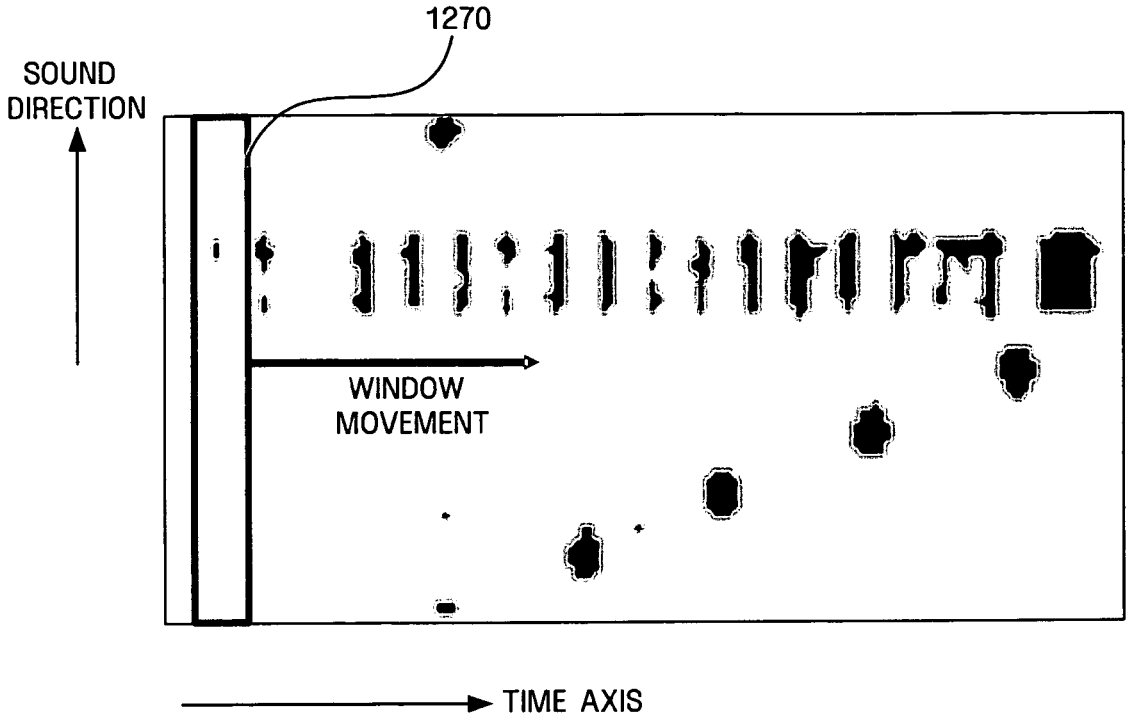
FIG. 15 is a view exemplifying a method for detecting blobs according to an embodiment of the present invention.

If all the pixels in the first image 1250 have the black/white values by the image binarizing, the blobs are detected (operation S1350), and locations of the detected blobs are output (operation 1360). FIG. 15 is a view exemplifying a method for detecting blobs according to an embodiment of the present invention.

In the embodiment of the present invention, the blob is a sign that indicates the existence of the sound, and is represented as a black spot.

The sound signals are successively inputted, and the most-recently inputted sound signal for a determined time T may appear in the window 1270 as illustrated in FIGS. 12 and 15.

To perform the intensity control more efficiently, it is preferable that one window includes pixels the number of which is larger than the 256 gray-scale levels. Also, to cope with the environment rapidly changing, it is preferable to perform the intensity control in a short time. According to one embodiment, T is set to five seconds.

According to one embodiment, if the number of pixels in black within the window 1270 exceeds a predetermined number, they are considered as blobs.

FIG. 16 is a view exemplifying a source program for performing a method for detecting blobs according to an embodiment of the present invention.

In the $1^{st}$ line, a variable, which indicates the respective pixel values of the image within the window with respect to the sound signal inputted during the time period T, is defined.

In the $2^{nd}$ line, a variable, which indicates the result of detecting blobs in a direction of 360°, is defined.

In the $3^{rd}$ line, index variables are defined, and in the $4^{th}$ line, a threshold value is defined as '4'. If the number of pixels in black is more than 4, they are considered as blobs.

In the $8^{th}$ line to $24^{th}$ line, it is calculated whether blobs exists in a specified direction determined by a 'dir' variable during the time period T.

That is, in the $8^{th}$ line, a 'detect_count' variable that counts the number of pixels in black is defined, and its initial value is set to '0'.

In the $10^{th}$ line to $16^{th}$ line, if a specified pixel is a pixel in black, the 'detect_count' variable is increased by one. In this case, if the pixel value, which is indicated by one byte, is less than 128, it is considered as a pixel in black.

In the $17^{th}$ line to 24 line, if the 'detect_count' variable is larger than the variable that indicates the threshold value, it is considered that the blob exists in the corresponding 'dir' direction.

After the blob is detected from the first image 1250, the detected location of the blob is outputted. The second image 1260 shows the result of detection.

Figure 17:
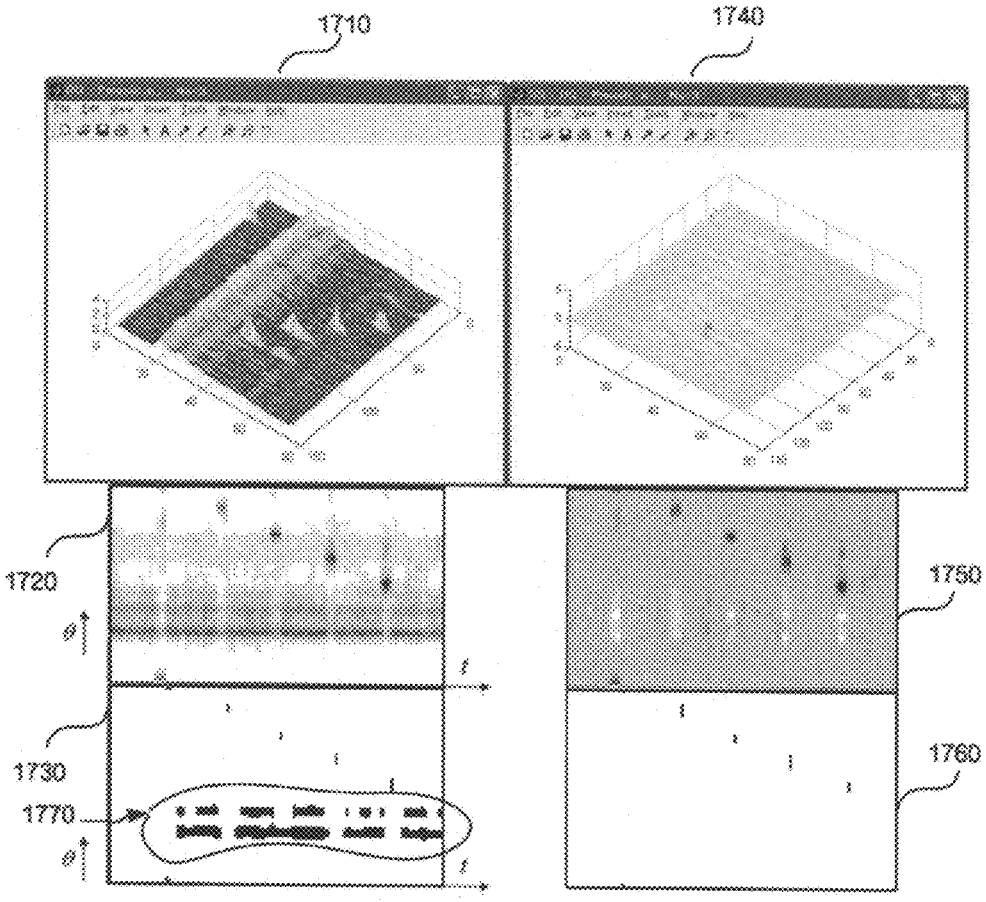
FIG. 17 is a view illustrating second resultant data of experimentation that indicates the estimation of a speaker's location for a non-stationary noise according to an embodiment of the present invention.

FIG. 17 is a view illustrating second resultant data of experimentation that indicates the estimation of the speaker's location for a non-stationary noise according to an embodiment of the present invention. In FIG. 17, the experimental results of estimating the locations of the speakers when the second noise is produced are illustrated.

In comparing the second images 1730 and 1760 of FIG. 17, it can be known that blobs 1770 are formed in a direction where non-stationary noises are produced in the case of the second image 1730 located on the left side. By contrast, blobs are normally formed in the second image 1760 using the MUSIC algorithm with spectral subtraction.

Figure 18:
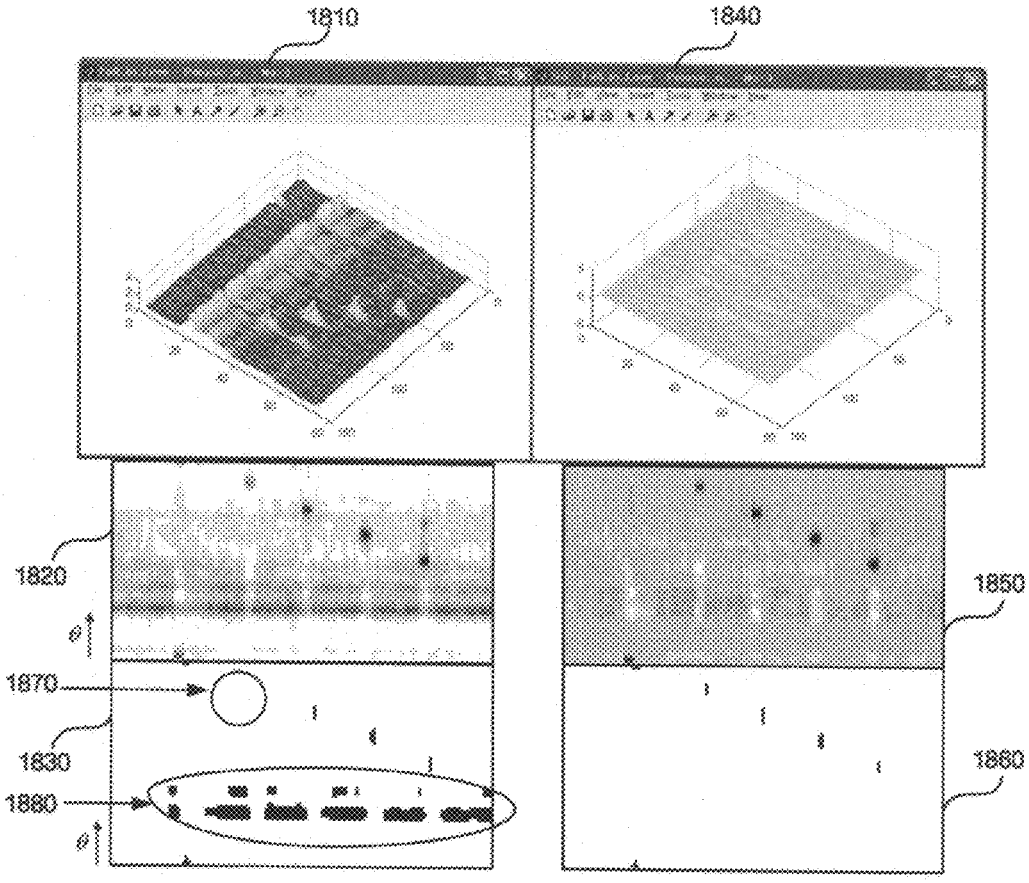
FIG. 18 is a view illustrating third resultant data that indicates the estimation of a speaker's location for a non-stationary noise according to an embodiment of the present invention.

FIG. 18 is a view illustrating third resultant data of experimentation that indicates the estimation of the speaker's location for a non-stationary noise according to an embodiment of the present invention. In FIG. 18, the experimental results of estimating the locations of the speakers when the third noise is produced are illustrated.

In comparing the second images 1830 and 1860 of FIG. 18, it can be known that blobs 1880 are formed in a direction where non-stationary noises are produced in the case of the second image 1830 located on the left side, and no blob 1870 is formed in a direction where the sound signal exists. By contrast, blobs are normally formed in the second image 1860 using the MUSIC algorithm with spectral subtraction.

Figure 19:
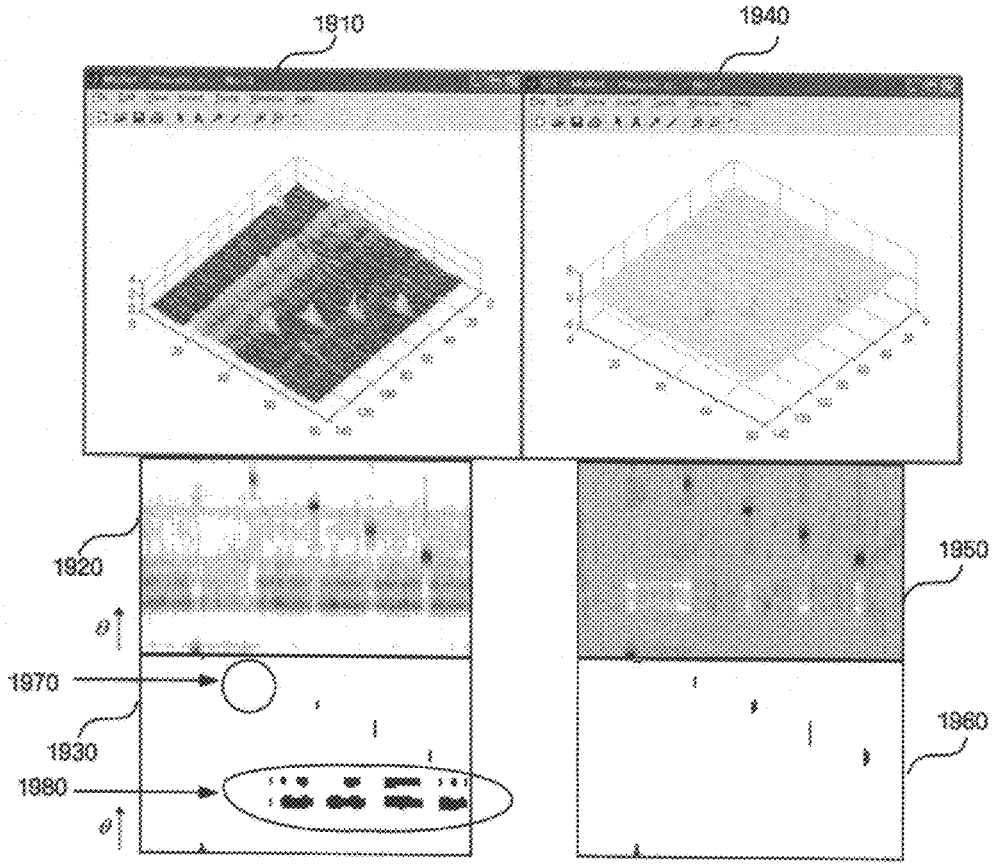
FIG. 19 is a view illustrating fourth resultant data that indicates the estimation of a speaker's location for a non-stationary noise according to an embodiment of the present invention.

FIG. 19 is a view illustrating fourth resultant data of experimentation that indicates the estimation of the speaker's location for a non-stationary noise according to an embodiment of the present invention. In FIG. 19, the experimental results of estimating the locations of the speakers when the fourth noise is produced are illustrated.

In comparing the second images 1930 and 1960 of FIG. 19, it can be known that blobs 1980 are formed in a direction where non-stationary noises are produced in the case of the second image 1930 located on the left side, and no blob, of which the corresponding part is denoted by 1970, is formed in a direction where the sound signal exists. By contrast, blobs are normally formed in the second image 1960 using the MUSIC algorithm with spectral subtraction.

Errors occurring during the estimation of the speaker's location according to the experimental results as shown in FIGS. 12, and 17 to 19 are shown in Table 1 below.

TABLE 1

(Unit: Degree (°))

| Speaker Localization | CANON | D.Q | F.I.L | MULLET |
|---|---|---|---|---|
| 0° | 357.5 | 355 | 355 | 353.3 |
| 45° | 35 | 37.5 | 37.5 | 37.5 |
| 90° | 85 | 85 | 82.5 | 80 |
| 135° | 127.5 | 127.5 | 127.5 | 130 |
| 180° | 172.5 | 175 | 172.5 | 172.5 |
| Average Error | 6.5 | 6 | 7 | 7.34 |
| Total Average Error | | 6.71 | | |

Figure 20:
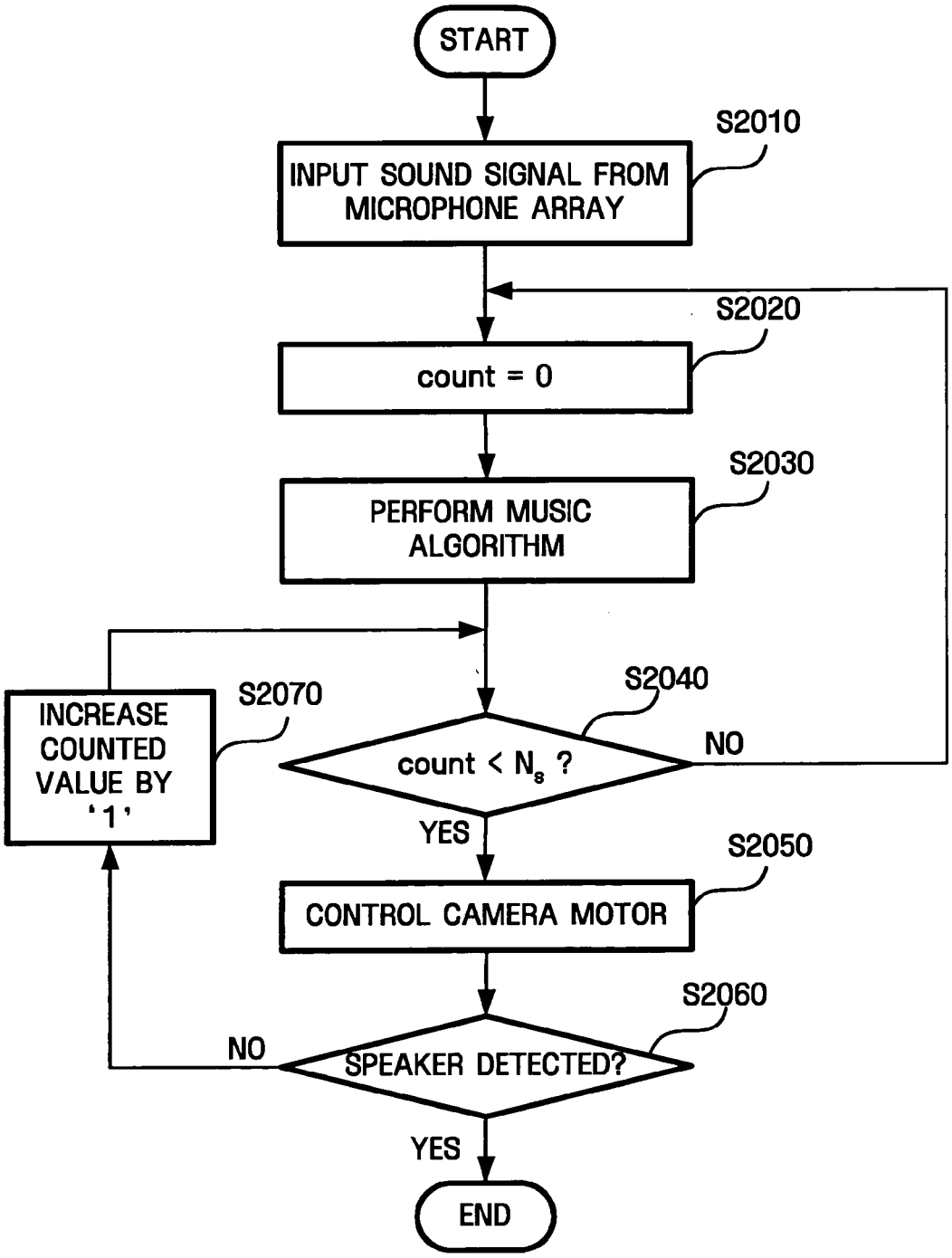
FIG. 20 is a flowchart illustrating a method for estimating a speaker's location according to an embodiment of the present invention.

FIG. 20 is a flowchart illustrating a method for estimating the speaker's location according to an embodiment of the present invention.

Referring to FIG. 20, the robot that has information about the sound map receives sound signals from a microphone array mounted on the robot itself (operation S2010). Then, the robot sets an initial value of the 'count' index variable to compare the number of sound signals with the assumed number of sound sources Ns to '0' (operation S2020), and then performs the MUSIC algorithm (operation S2030). In this case, the MUSIC algorithm with spectral subtraction is used. That is, the sound signals are detected using spectrum information obtained by subtracting the pre-stored information about the sound map from the spatial spectrum information including the inputted sound signals.

If the MUSIC algorithm is completely performed, the robot compares the 'count' variable value with the $N_s$ value. That is, if the MUSIC algorithm is performed, peaks of the spatial spectrum may be formed in several directions, and at this time, the directions of the sound signals are found within the range of the $N_s$ value.

Accordingly, if the 'count' variable value is not smaller than the $N_s$ value, the robot sets the 'count' variable value to '0' again, and performs the MUSIC algorithm (operations S2040, S2020, and S2030).

But if the 'count' variable value is smaller than the $N_s$ value, the robot rotates a camera using a camera motor in a direction where the largest peak among peaks formed in the spatial spectrum is formed (operation S2050). In this case, if the speaker is detected through the screen of the camera, the process of estimating the speaker's location is terminated. A method for detecting and recognizing the speaker is described in detail by i) Pedestrian detection using wavelet templates (Oren, M.; Papageorgiou, C.; Shnha, P.; Osuna, E.; Poggio, T; IEEE International Conference on Computer Vision and Pattern Recognition, 1997), ii) Human detection using geometrical pixel value structures (Utsumi, A.; Tetsutani, N.; IEEE International Conference on Automatic Face and Gesture Recognition, 2002), iii) Detecting Pedestrians Using Patterns of Motion and Appearance (Viola P; Jones M. J.; Snow D.; IEEE International Conference on Computer Vision, 2003), and iv) Rapid Object Detection Using a Boosted Cascade of Simple Features (Viola P.; Jones M. J.; IEEE International Conference on Computer Vision and Pattern Recognition, 2001).

But if the speaker is not detected, it may exist in a direction of a fixed sound source, and thus the direction of the speaker is detected by controlling the direction of the camera in the order of directions having larger peak values. In this case, the 'count' variable value is increased by one (operation S2070).

Figure 21:
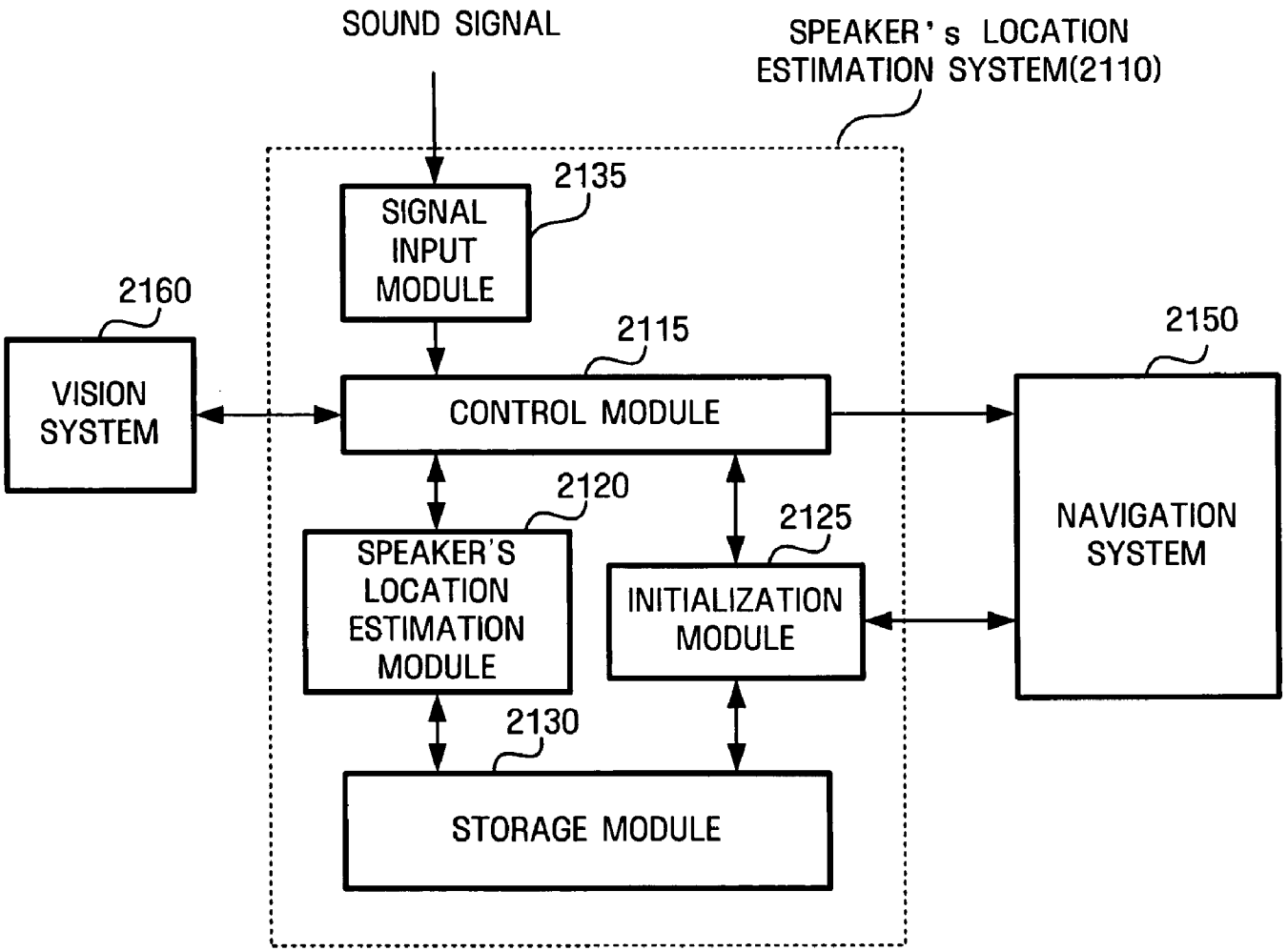
FIG. 21 is a block diagram illustrating the construction of a robot to estimate a speaker's location according to an embodiment of the present invention.

FIG. 21 is a block diagram illustrating the construction of a robot for estimating the speaker's location according to an embodiment of the present invention.

The robot includes a navigation system 2150 to calculate and control the movement and location of the robot itself, a system 2110 to estimate the speaker's location, and a vision system 2160 having a built-in image input device, such as a camera.

The speaker's location estimation system 2110 includes a signal input module 2135, a control module 2115, an initialization module 2125, a storage module 2130, and a speaker's location estimation module 2120.

The signal input module 2135 receives the sound signals from an outside. The initialization module 2125 prepares a sound map on which a spatial spectrum of the sound signals, which are produced from at least one fixed sound source and received by the signal input module 2135, is arranged, and estimates the locations of the fixed sound sources from the sound map. The storage module 2130 stores information about the locations of the estimated fixed sound sources. The speaker's location estimation module 2120 estimates the locations where the sound signals are produced using information about the spatial spectrum of the sound signals including the sound signal received by the signal input module 2135 and information about the locations of the estimated fixed sound sources.

The initialization module 2125 receives information about the movement and location of the robot from the navigation system 2150, and prepares the sound map according to the methods illustrated in FIGS. 2 to 8, using the received information. Then, the initialization module 2125 estimates the locations of the fixed sound sources from the prepared sound map. The information about the sound map and the information about the estimated locations of the fixed sound sources are stored in the storage module 2130.

If the sound signal is received from the signal input module 2135, the control module 2115 makes the speaker's location estimation module 2120 estimate the direction of the received sound signal. In this case, the speaker's location estimation module 2120 estimates the direction of the speaker who produces the sound signal according to the methods illustrated in FIGS. 12 to 20, using the information about the sound map stored in the storage module 2130 and the information about the estimated locations of the fixed sound sources. At the same time, the vision system 2160 confirms whether the speaker is located in the direction where the sound signal is produced by rotating the camera mounted on the robot in the direction where the sound signal is produced according to the command of the control module 2115.

As described above, according to the present invention, the direction of the speaker who produces the sound signal can be estimated from the present location of the robot even in a non-stationary noise environment.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A system to estimate a speaker's location in a non-stationary noise environment, comprising:

a signal input module receiving a first sound signal from at least one fixed sound source, the fixed sound source being external to the system;

an initialization module preparing a sound map, on which a spatial spectrum for the first sound signal and received by the signal input module is arranged, and estimating a location of the fixed sound source;

a storage module storing information about the estimated location of the fixed sound source; and a speaker's location estimation module estimating a location where a second sound signal is produced using information about a spatial spectrum for sound signals including the first sound signal received by the signal input module and the information about the estimated location of the fixed sound source.

2. The system as claimed in claim 1, wherein the signal input module comprises a microphone array including at least two microphones.

3. The system as claimed in claim 1, wherein the spatial spectrum includes information about a level of the first sound signal according to a direction of the first sound signal.

4. The system as claimed in claim 1, wherein the sound map includes information that indicates the first sound signal produced from the fixed sound source as the spatial spectrum according to a multiple signal classification (MUSIC) algorithm in a two-dimensional planar space including the fixed sound source.

5. The system as claimed in claim 4, wherein the sound map includes respective spatial spectrum information of at least two areas among a plurality of areas obtained by dividing the two-dimensional planar space.

6. The system as claimed in claim 1, wherein the initialization module forms respective tracks in directions where levels of the sound signals exceed a predetermined threshold on the spatial spectrum in an area that includes at least two different locations on the prepared sound map, and if the respective tracks converge into an area of the sound map, the initialization module estimates the converging area as the location of the fixed sound sources.

7. The system as claimed in claim 1, wherein the initialization module estimates a maximum value of a potential function set in proportion to a level of the first sound signal produced from the fixed sound source as the location of the fixed sound source.

8. The system as claimed in claim 1, wherein the speaker's location estimation module obtains the spatial spectrum by a multiple signal classification (MUSIC) algorithm with spectral subtraction using information about the spatial spectrum for the sound signals including the first sound signal received by the signal input module and the information about the estimated location of the fixed sound source, and estimates the location where the second sound signal is produced by processing a gray-scaled image corresponding to the spatial spectrum by the MUSIC algorithm with spectral subtraction.

9. The system as claimed in claim 8, wherein the speaker's location estimation module binarizes the gray-scaled image, and estimates the location where the sound signal is produced according to a pattern of successive pixels constituting the binarized image.

10. The system as claimed in claim 9, wherein the binarized image is an intensity-controlled image.

11. The system as claimed in claim 9, wherein the binarized image is produced by binarizing values of the pixels constituting the gray-scaled image into values corresponding to black or white based on a threshold value.

12. The system as claimed in claim 11, wherein the threshold value is calculated by an Otsu method.

13. The system as claimed in claim 9, wherein if the number of successive pixels having the same pixel value and constituting the binarized image exceeds a preset number, the speaker's location estimation module estimates a direction where the pixels are located as a direction where the sound signal is produced.

14. A method for estimating a speaker's location in a non-stationary noise environment implemented by a system to estimate the speaker's location, comprising the operations of:

(a) preparing a sound map on which a spatial spectrum for a first sound signal produced from at least one fixed sound source is arranged;

(b) estimating a location of the fixed sound source from the sound map;

(c) storing information about the estimated location of the fixed sound source; and (d) estimating a location where a second sound signal is produced using information about a spatial spectrum for sound signals including the first sound signal and the information about the estimated location of the fixed sound source, if the second sound signal is detected.

15. The method as claimed in claim 14, wherein the spatial spectrum includes information about a level of the first sound signal according to a direction of the first sound signal.

16. The method as claimed in claim 14, wherein the sound map includes information that indicates the first sound signal produced from the fixed sound source as the spatial spectrum according to a multiple signal classification (MUSIC) algorithm in a two-dimensional planar space including the fixed sound source.

17. The method as claimed in claim 16, wherein the sound map includes respective spatial spectrum information of at least two areas among a plurality of areas obtained by dividing the two-dimensional planar space.

18. The method as claimed in claim 14, wherein the estimating the location of the fixed sound source from the sound map comprises the operations of:

(b-1) forming respective tracks in directions where levels of the sound signals exceed a predetermined threshold on the spatial spectrum in an area that includes at least two different locations on the prepared sound map; and (b-2) repeating the operation (b-1), starting from end points of the respective tracks; and (b-3) if the respective tracks converge into an area of the sound map, estimating the converging area as the location of the fixed sound sources.

19. The method as claimed in claim 14, wherein the estimating the location of the fixed sound source from the sound map comprises the operations of:

setting a potential function in proportion to a level of the first sound signal produced from the fixed sound source;

forming direction vectors, which are gradient information of the potential function, in directions where levels of the sound signals exceed a predetermined threshold on the spatial spectrum arranged on the sound map; and estimating a location corresponding to a maximum value of the potential function as a location of the fixed sound source if the maximum value of the potential function is found using the direction vectors.

20. The method as claimed in claim 14, wherein the estimating the location where the second sound signal is produced using information about the spatial spectrum for sound signals including the first sound signal and the information about the estimated location of the fixed sound source comprises the operations of:

(d-1) obtaining the spatial spectrum by employing a multiple signal classification (MUSIC) algorithm with spectral subtraction using information about the spatial spectrum for the detected sound signals and the information about the estimated location of the fixed sound source; and (d-2) obtaining a gray-scaled image corresponding to the spatial spectrum obtained at the operation (d-1);

(d-3) estimating the location where the sound signal is produced by processing the gray-scaled image.

21. The method as claimed in claim 20, further comprising the operations of:

controlling an intensity of the gray-scaled image;

binarizing the intensity-controlled image; and estimating the location where the sound signal is produced by processing the binarized image.

22. The method as claimed in claim 21, wherein the operation of binarizing the intensity-controlled image comprises the operation of binarizing values of the pixels constituting the intensity-controlled image into values corresponding to black or white based on a threshold value.

23. The method as claimed in claim 21, wherein the threshold value is calculated by an Otsu method.

24. The method as claimed in claim 21, wherein the operation of estimating the location where the sound signal is produced comprises the operation of estimating a direction where the pixels are located as a direction where the sound signal is produced if the number of successive pixels having the same pixel value exceeds a preset number.

25. The method as claimed in claim 14, wherein the sound signal is received by a microphone array including at least two microphones.

26. The method as claimed in claim 14, further comprising:

if the second sound signal includes information that requires a specified operation, performing the specified operation.

* * * * *